US006174848B1

(12) United States Patent
Dawson et al.

(10) Patent No.: US 6,174,848 B1
(45) **Date of Patent: *Jan. 16, 2001**

(54) PROCESS AND DISPENSING DEVICE FOR WASHING LAUNDRY IN A WASHING MACHINE

(75) Inventors: George Thomas Dawson, Wirral (GB); Francois Delwel, Vlaardingen (NL); James William Gordon, Vlaardingen (NL); Albert Cornelis de Jong, Vlaardingen (NL); Colin Watt Kerr, Wirral (GB); Edwin Leo Lempers, Vlaardingen (NL); Loic Marie Tardy, Ho Chi Minh (VN)

(73) Assignee: Lever Brothers Company, div. of Conopco Inc., New York, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/035,162

(22) Filed: Mar. 5, 1998

(30) Foreign Application Priority Data

Mar. 7, 1997 (GB) ..... 9704782

(51) Int. Cl.[7] ..... D06F 39/02

(52) U.S. Cl. ..... 510/297; 68/17 R; 206/0.5; 383/117; 510/298

(58) Field of Search ..... 8/158, 159, 137; 68/17 R; 206/0.5; 510/297, 298; 383/117

(56) References Cited

U.S. PATENT DOCUMENTS

| | | | | |
|---|---|---|---|---|
| 2,470,851 | | 5/1949 | Hermanson | 252/93 |
| 3,178,915 | * | 4/1965 | Hertel | 68/17 R |
| 4,047,550 | | 9/1977 | Scholz | 150/52 |
| 4,228,834 | | 10/1980 | Desnick | 150/3 |
| 4,253,842 | * | 3/1981 | Ehrlich | 68/17 R X |
| 4,260,054 | | 4/1981 | Bory et al. | 206/0.5 |
| 4,969,927 | | 11/1990 | Schumann et al. | 8/159 |
| 5,129,120 | * | 7/1992 | Cornette et al. | 8/137 X |
| 5,238,305 | * | 8/1993 | Feller | 383/117 X |

FOREIGN PATENT DOCUMENTS

| | | |
|---|---|---|
| 195 18 843 | 11/1996 | (DE) . |
| 002 293 | 6/1979 | (EP) . |
| 343 069 | 5/1989 | (EP) . |
| 0473532 | 3/1992 | (EP) . |
| 0576234 | 12/1993 | (EP) . |
| 0610535 | 8/1994 | (EP) . |
| 0628652 | 12/1994 | (EP) . |
| 0479711 | 12/1995 | (EP) . |
| 0691102 | 1/1996 | (EP) . |
| 0473532 | 3/1996 | (EP) . |
| 846 798 | 6/1998 | (EP) . |
| 90/02165 | 8/1989 | (WO) . |
| 91/04368 | 9/1990 | (WO) . |
| 99/55822 | 11/1999 | (WO) . |

* cited by examiner

*Primary Examiner*—Philip R. Coe
(74) *Attorney, Agent, or Firm*—Rimma Mitelman

(57) ABSTRACT

A process for washing laundry in a washing machine employs a receptacle for dispensing detergent tablets. The receptacle comprises a loosely fitting net bag having apertures with an average mesh size of between 1 and 10 mm. One or more tablets are placed in the dispensing receptacle before being placed into a washing machine along with laundry to be washed and a washing operation is carried. After the washing operation, the device is removed from the machine and stored for subsequent use.

Moreover, the invention relates to a dispensing device for carrying out this process and a use of the device in laundry washing.

21 Claims, 7 Drawing Sheets

PROCESS AND DISPENSING DEVICE FOR WASHING LAUNDRY IN A WASHING MACHINE

INTRODUCTION

The invention relates to a process for washing laundry in a washing machine by employing a receptacle for dispensing at least one detergent tablet, the receptacle comprising a net structure having a plurality of apertures for permitting the passage of an aqueous solution there through, the process comprising the steps of placing the dispensing receptacle having at least one detergent tablet contained therein in a washing machine together with the laundry to be washed, and carrying out a washing operation. The invention also relates to a dispensing device for carrying out the above process.

Dispensing devices for detergent tablet compositions are known. For example DK-B-165 759 discloses a dispensing device having a flexible fluid permeable sleeve arranged in an enclosing manner about a rigid hollow body forming an annular chamber between the sleeve and the body, the body having an inlet opening for insertion of the tablet. EP-A1-0628 652 describes a similar dispensing device. Both of these devices include relatively complicated means for delivering a tablet from the opening in the hollow body to the annular chamber, are expensive to make and complicated in use.

EP-A1-0-473-532 discloses a further dispensing device for use with detergent tablets which comprises a water permeable fabric bag having a slotted opening and a freely movable body within the bag to effect the disintegration of the tablet. If, however, the fabric bag described above was analysed after a washing operation, a large number of detergent residues would be embedded in the material of the bag. This results in detergent being wasted and the bag having decreased water permeability.

EP O 699 410 discloses a dispenser for, primarily machine dishwash, detergent tablets which comprises an open topped rigid cage having pincers for picking up tablets. A problem with this device is that the apertures in the cage appear quite large and thus would allow large undissolved tablet particle escape into the wash to cause dye damage to the clothes. Further problems are the rather complicated structure and the noice which results from the use of such a rigid device in washing machines.

EP 0 479 711 describes a further device comprising a two-part rigid sleeve having an outer sleeve of flexible water permeable material. In use a tablet is inserted between the rigid and flexible sleeves before the device is placed in a washing machine. Again this device is of quite complicated construction. Further it requires considerable dexterity for successful positioning of the tablet between the two sleeves.

EP 0 691 102 describes a cage dispenser for tablets having a child resistant closure. The apertures in the cage are quite large and would allow sizeable detergent particle escape into the wash. Further, the dispenser would suffer from noise problems.

EP O 610 535 discloses a fabric bag dispenser for powdered detergents, the bag having holes of a size sufficient to allow water penetrate but preventing the powder escape. The use of such a bag with detergent tablets would likely lead to poor break-up and dissolution of the tablet and result in a high level of residues left in the bag.

EP O 576 234 describes a tablet dispenser comprising an elastic net sleeve which, upon insertion of the tablets, conforms tightly to the tablets. A number of problems are associated with this dispenser. First, as the tablets are held by the sleeve in a face to face configuration, less of the tablets surface area is exposed to the wash water. This leads to a decreased rate of dissolution of the tablets which results in a greater level of detergent residues left in the machine after the wash. A consequence of this is an increased incidence of dye fading due to detergent residues or particles coming into direct contact with clothes. Second, as the net conforms tightly to the tablets, the tablets are firmly pushed against the net resulting in parts of the tablet being exposed through the net to the clothes in the wash. Such exposure will lead to increased levels dye damage. Furthermore, as the elastic net prevents the tablets moving around the net, mechanical disintegration of the tablets is reduced. Finally, as the net is elastic, the mouth of the sleeve tends to be quite small which makes insertion of the tablets difficult.

It is an object of the present invention to provide a dispensing device and washing process which overcomes at least some of the above problems.

STATEMENTS OF INVENTION

According to the invention, there is provided a laundry washing process of the above type, the process being characterised in that the net structure is a loosely fitting net bag, wherein the apertures of the net have an average mesh size of between 1 mm and 10 mm.

Surprisingly, it has been found that as the mesh size of the net increases above 1 mm, that the incidence of dye damage, ie. the effect of direct contact between the tablet and the clothes, decreases. It would have been expected that for net shuttles, as the size of the holes in the net increased, the greater the dye damage would be due to the greater exposure of the tablet through the holes in the net. In practice, the opposite effect has been observed when the process of the invention is carried out.

A further surprising effect of the process of the present invention is that the incidence of detergent tablet residues remaining in the machine after a washing operation decreases. This is quite unexpected in so far as it would be assumed that, as the mesh size of the net increases, the greater the number of undissolved residues within the net would escape into the wash. However, again, the opposite effect has been observed with the process of the invention.

The mesh size of the net in the present invention is limited to less than 10 mm. Mesh sizes above this figure result in large particles escaping into the wash. This is undesirable due to the increased incidence of dye damage which results.

The use of a loosely fitting net bag has a number of advantages. Firstly, the greater volume of the bag (when compared with an elastic sleeve), results in a decreased incidence of the bag becoming lodged in the port hole of the machine during washing. Secondly, the fact that the bag is loosely fitting allows tablets contained within the bag to mechanically act against each other thereby improving the rate of dissolution of the tablet. Thirdly, with the loosely fitting bag of the invention, the tablets are not held in a tightly conforming arrangement (as is the case with an elastic net sleeve), thus a greater surface area of the tablets is exposed to the wash water.

In one embodiment of the process, the average mesh size of the net is at least 2 mm, ideally at least 3 mm, more preferably at least 4 mm and most preferably approximately 5 mm. Typically, the average mesh size of the net is at most 9 mm, ideally at most 8 mm, preferably at most 7 mm, and most preferably at most 6 mm.

Preferably the net bag apertures with an average mesh size of approximately 5 mm.

In one embodiment of the invention, the detergent tablet comprises a tripolyphosphate composition, typically comprising a compacted particulate detergent composition containing one or more detergent-active compounds together with sodium tripolyphosphate and other ingredients, and in which the tablet or a region thereof comprises particles which contain sodium tripolyphosphate with a content of the phase 1 form which is more than 40% by weight of the sodium tripolyphosphate in said particles, wherein the sodium tripolyphosphate in said particles contains water of hydration distributed throughout the tripolyphosphate in an amount between 1% and 5% by weight of the sodium tripolyphosphate in the particles.

Alternatively, the detergent tablet may comprise sodium acetate trihydrate, optionally together with sodium citrate dihydrate. Such a composition may for example comprise a compacted particulate composition in which the tablet comprises a compacted particulate composition in which the tablet or a region thereof comprises from 15% to 93% by weight of a water-softening agent, wherein the tablet or a region thereof contains 2% to 35% by weight of a salt which is sodium acetate trihydrate, potassium acetate or mixture thereof, optionally together with sodium citrate dihydrate, such that the total quantity of sodium acetate trihydrate, potassium acetate and sodium citrate dihydrate is from 7% to 50% by weight of the tablet or a region thereof.

Typically, the net bag is reusable and comprises an opening for reception of the or each detergent tablet and closure means for closing the opening to prevent the passage of the or each tablet out of the receptacle through the opening, the process including the initial step of placing one or more detergent tablets in the dispensing receptacle prior to closing the opening. In this manner it is a simple operation to open the bag and place one or more tablets therein and subsequently close the bag.

In one embodiment of the process, the opening is defined by an annular support wherein the closure means comprises a plurality of resiliently flexible members such as fingers mounted on the annular support, which members project radially at least partially across the opening. Alternatively, the closure may comprise a diaphragm mounted across the support, which diaphragm includes an aperture for insertion of a tablet. Ideally, the diaphragm comprises a resiliently deformable material.

In a further embodiment of the process, the closure means comprises zip means. Alternatively the opening may be defined by a pair of lips, which lips are movable together and apart in a purse-like manner to open and close the opening. In a particularly preferred embodiment of the process, the closure comprises a drawstring arrangement, which ideally includes clamp means attached to the drawstring to lock the bag in an open or closed orientation.

Preferably, the net bag of the process of the invention will include a volume adding member. In many of the embodiments above, the volume adding member will be provided by the closure, such as for example the annular support at the mouth of the bag, or the pair of lips. Ideally, the volume adding member comprises a resiliently deformable ring attached to the base of the bag and preferably dimensioned to conform tightly to a perimeter of the base. The inclusion of such a volume adding member has been shown to decrease the incidence of lodging, facilitate the finding of the bag after a washing operation, and to favour water flow through the device.

Typically, the net bag is produced from a material capable of withstanding temperatures for the machine washing or drying of laundry, especially up to 150° C. Such a material is sold under the trade name NETLON. However other materials capable of withstanding the above temperatures are envisaged.

The invention also seeks to provide a dispensing device for carrying out the above process, which device comprises a net bag for housing one or more detergent tablets, the net bag having a plurality of apertures for permitting the passage of an aqueous solution there through, the device being characterised in that the net bag is a loosely fitting structure, wherein the apertures in the net have an average mesh size of between 1 and 10 mm.

Preferably the device according to the invention includes a net bag having apertures with an average mesh size of approximately 5 mm.

Further, the invention provides a dispensing device according to the invention in combination with a detergent in a solid, non powder form, ideally a tablet.

DETAILED DESCRIPTION OF THE INVENTION

The invention will be more clearly understood from the following description of some embodiments thereof, given by way of example only, with reference to the accompanying drawings in which.

Figure 1:
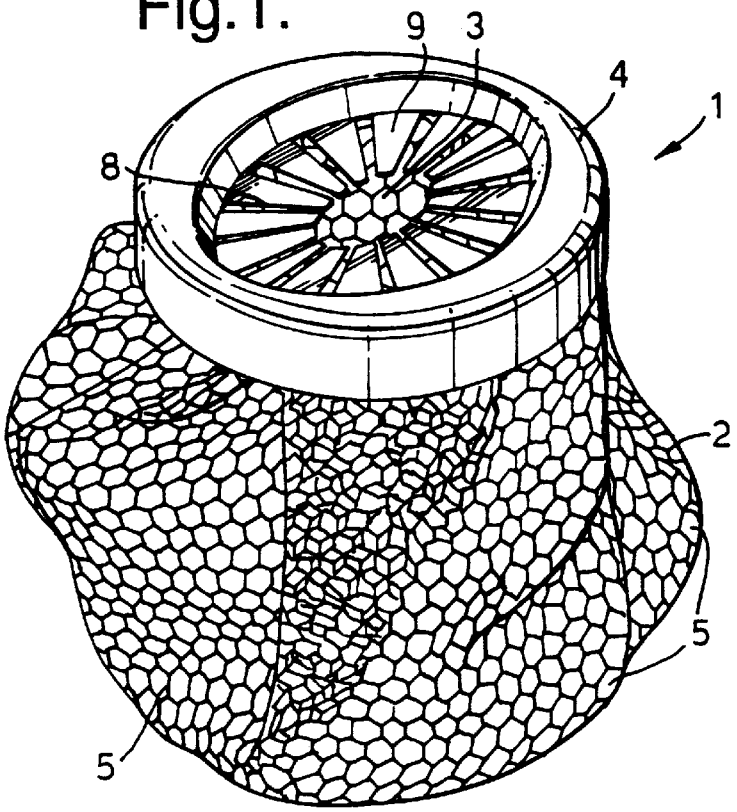
FIG. 1 is a perspective view of a dispensing device according to the invention.
Figure 3:
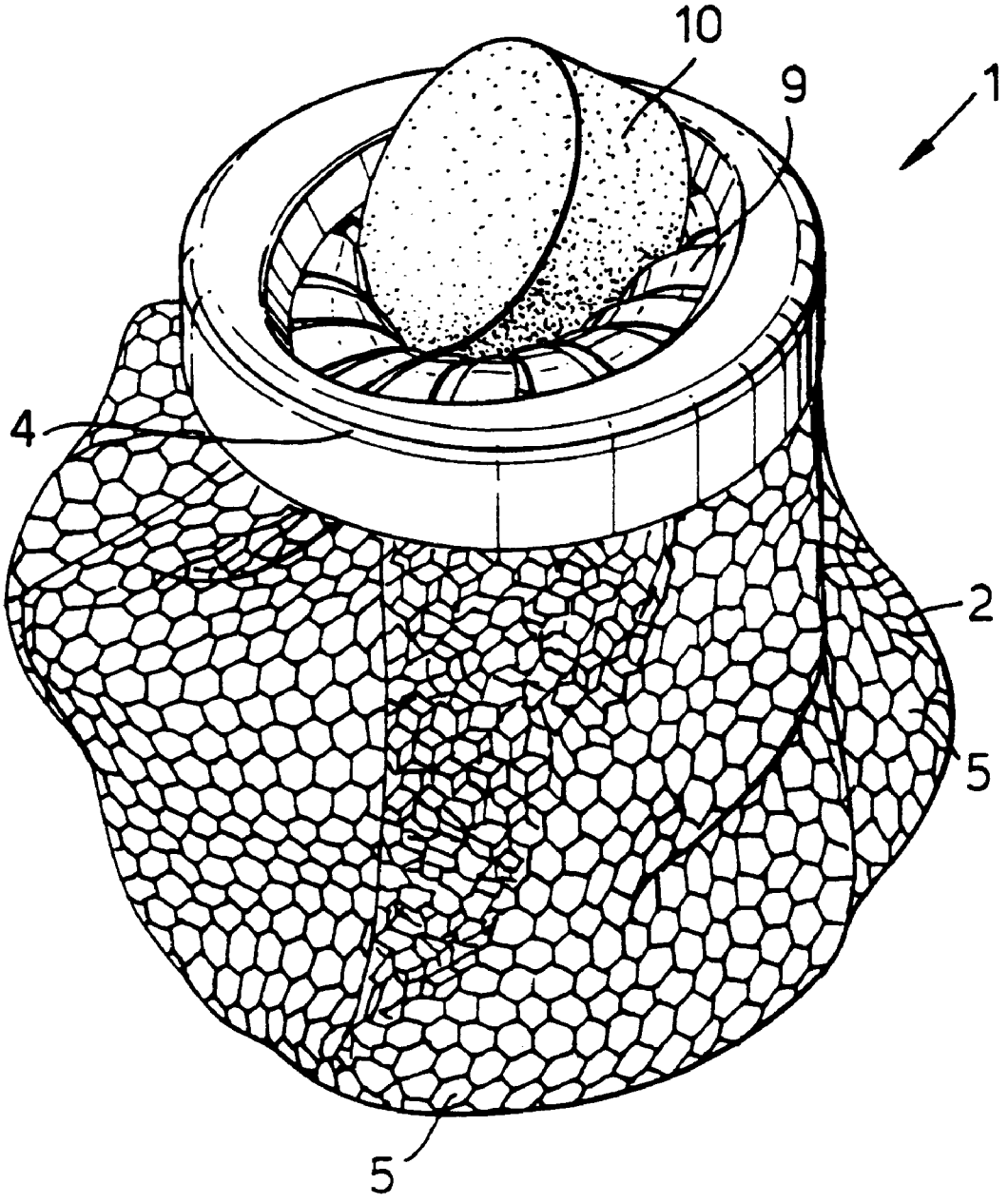
FIG. 3 is a perspective view of the device of FIG. 1 with a tablet partially inserted therein.

Referring to the drawings, and initially to FIGS. 1 and 3 thereof, there is illustrated a dispensing device according to the invention indicated generally by the reference numeral 1 and comprising a receptacle for detergent tablets in the form of a flexible, loosely fitting, net bag 2 having a open mouth 3, which is connected to and supported in an open configuration by a rigid annular support 4, and apertures 5 having an average mesh size of approximately 5 mm. A closure 8 for the mouth 3 comprises sixteen resiliently flexible fingers 9 mounted to the support 4 and extending radially across a portion of the mouth 3 of the bag 2 this forming a partial barrier which is sufficient in size and of sufficient resiliency to prevent a detergent tablet 10 passing out of the bag 2 during a conventional operation.

In use and referring to FIG. 3, a detergent tablet 10 is placed in the device 1 by pushing the tablet 10 against the barrier 8 until the radial fingers 9 bend sufficiently to allow the tablet 10 past the barrier 8. Generally two tablets will be used in a convention operation. The device 1 and tablets 10

(only one shown) contained therein are then placed in a washing machine together with the laundry to be washed and a washing operation is carried out during which the detergent tablet(s) within the bag 2 will disintegrate and dissolve. Any undissolved particulate disintegration products of the tablet of a size less then 5 mm will pass out of the bag 2 and be dissolved outside the bag 2. When the washing operation has been completed, the device 1 is removed from the machine and stored for subsequent use.

Figure 2:
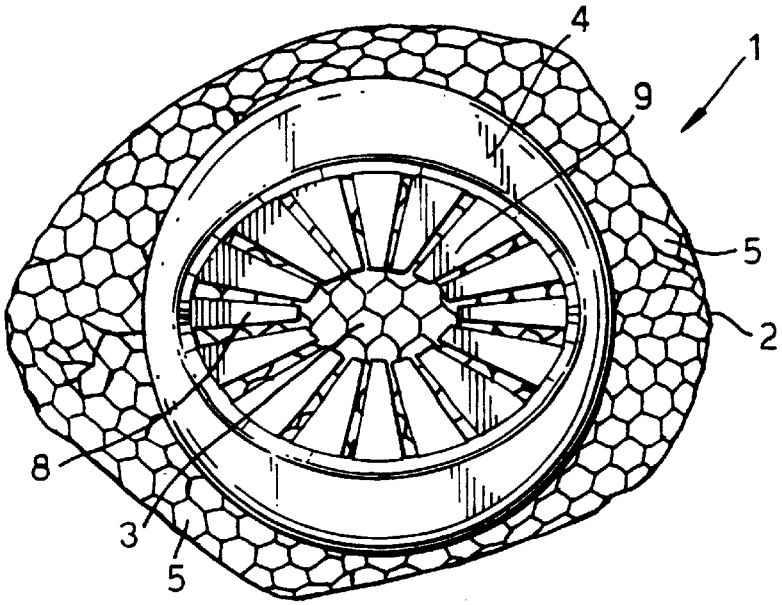
FIG. 2 is a top plan view of the device of FIG. 1.
Figure 4:
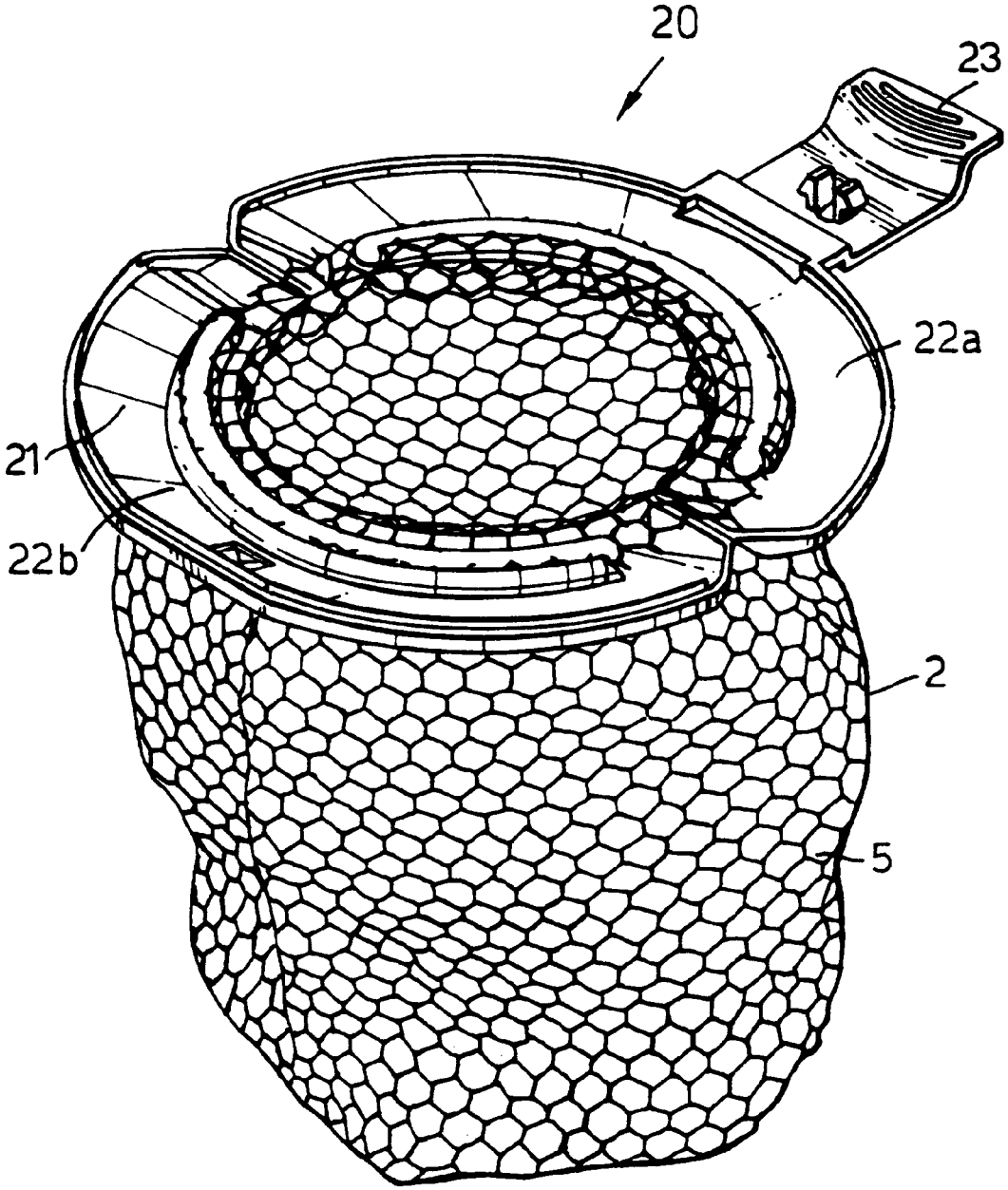
FIG. 4 is a perspective view of a dispensing device according to an alternative embodiment of the invention in an open configuration.
Figure 5:
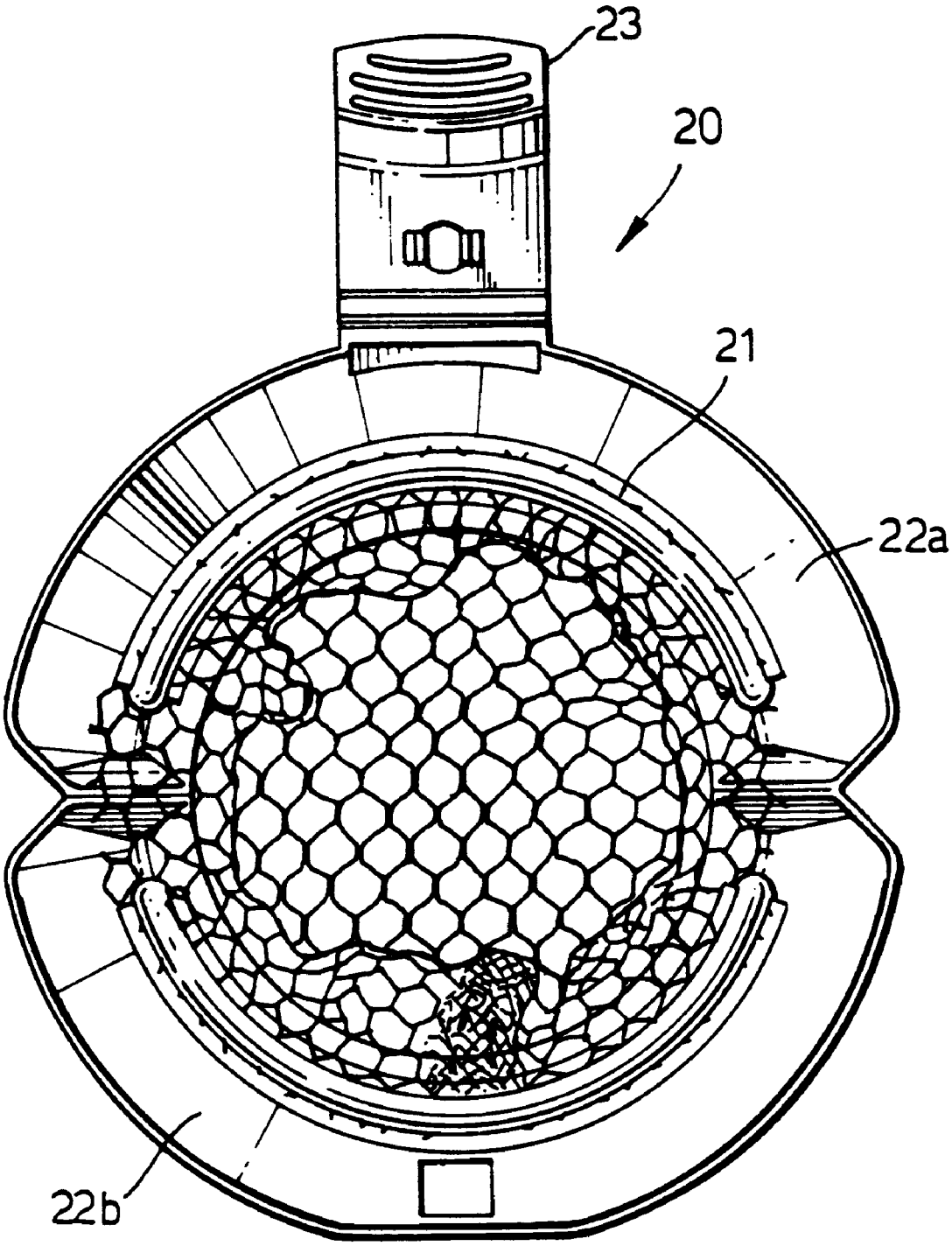
FIG. 5 is a top plan view of the device of FIG. 4.
Figure 6:
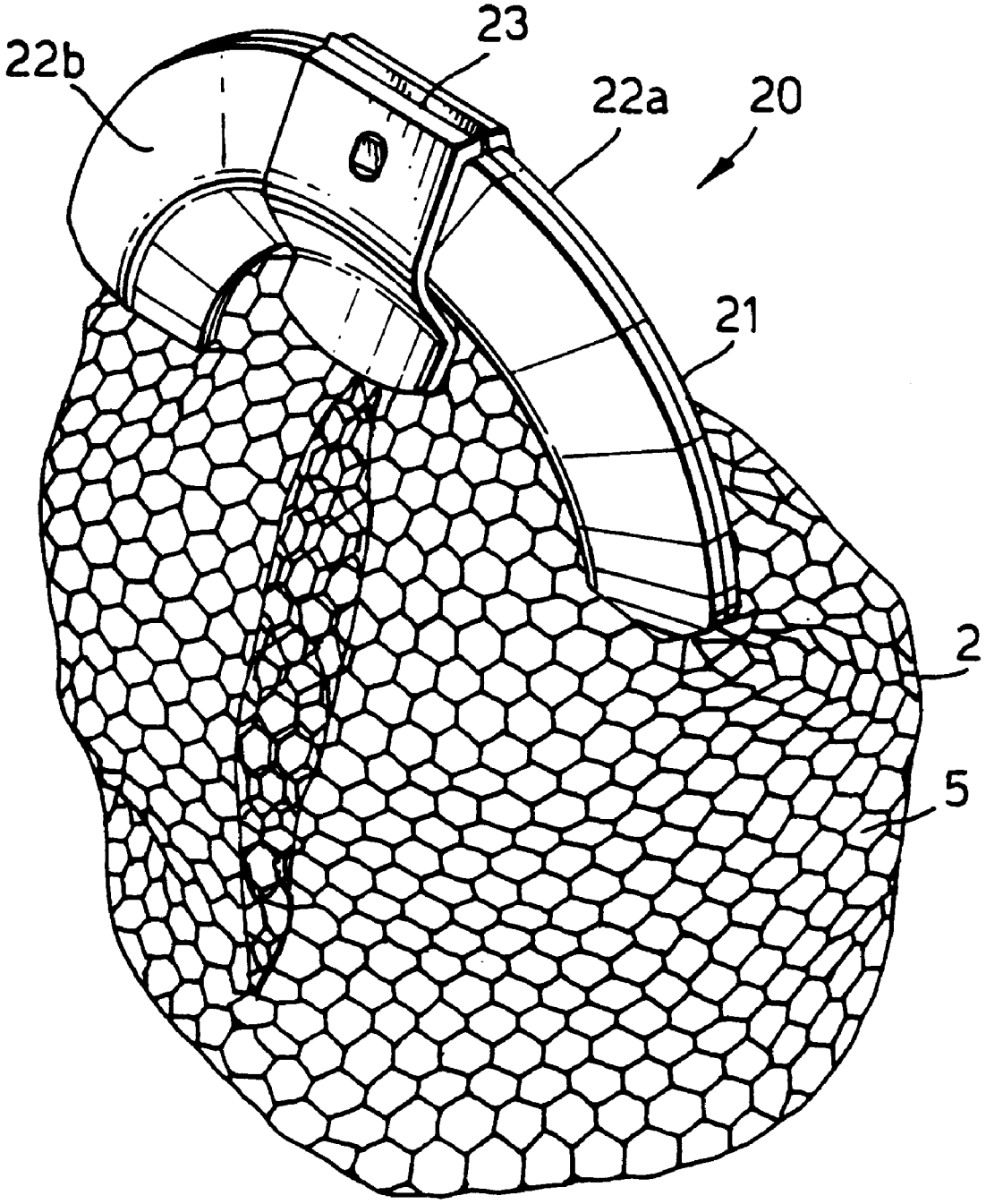
FIG. 6 is a partially side-on perspective view of the device of FIG. 4 in a closed orientation.

Referring to FIGS. 4 to 6, another embodiment of the invention is described in which parts similar to those described with reference to FIGS. 1 to 3 are given the same reference numerals. In this embodiment, the device, indicated by the reference numeral 20, includes a purse type closure 21 connected to the mouth 3 of the bag 2, which closure 21 comprises a pair of rigid semi-circular lips 22*a,* 22*b,* hingedly connected at each end, and movable together and apart to open and close the mouth. A clip 23 is provided on one of the lips 22*a* to lock the lips in a closed orientation. The use of this embodiment of the invention is similar to that described previously with the exception for the operation of the closure means which will be readily apparent.

Figure 7:
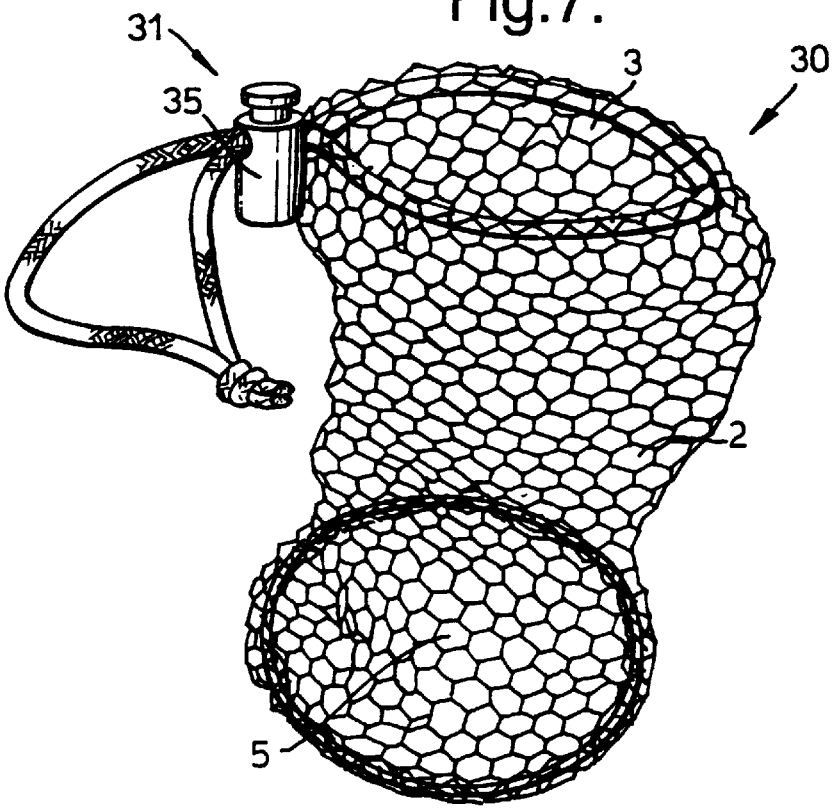
FIG. 7 is a perspective view of an alternative embodiment of the invention having a draw-string closure in an open orientation.
Figure 8:
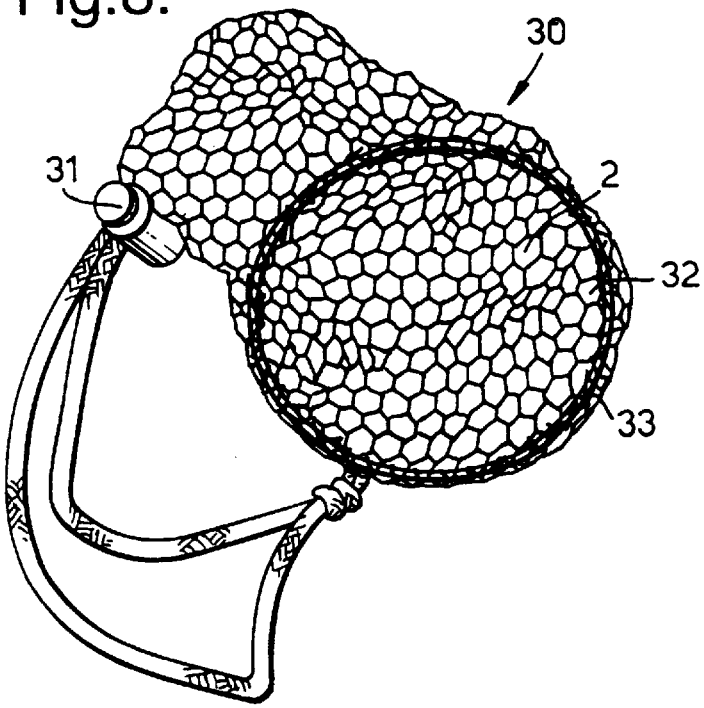
FIG. 8 is a perspective view of the device of FIG. 7 with the draw-string closure in a closed orientation.

Referring to FIGS. 7 and 8, a further embodiment of the invention is described in which parts similar to those described with reference to FIGS. 1 to 3 are assigned the same reference numerals. In this embodiment, the device indicated by the reference numeral 30 includes a drawstring closure arrangement 31 having a toggle clamp 35 movable thereon, and a supporting ring 32 located on a base 33 of the device 30. The operation and construction of the drawstring closure will be apparent to those skilled in the art.

Figure 9:
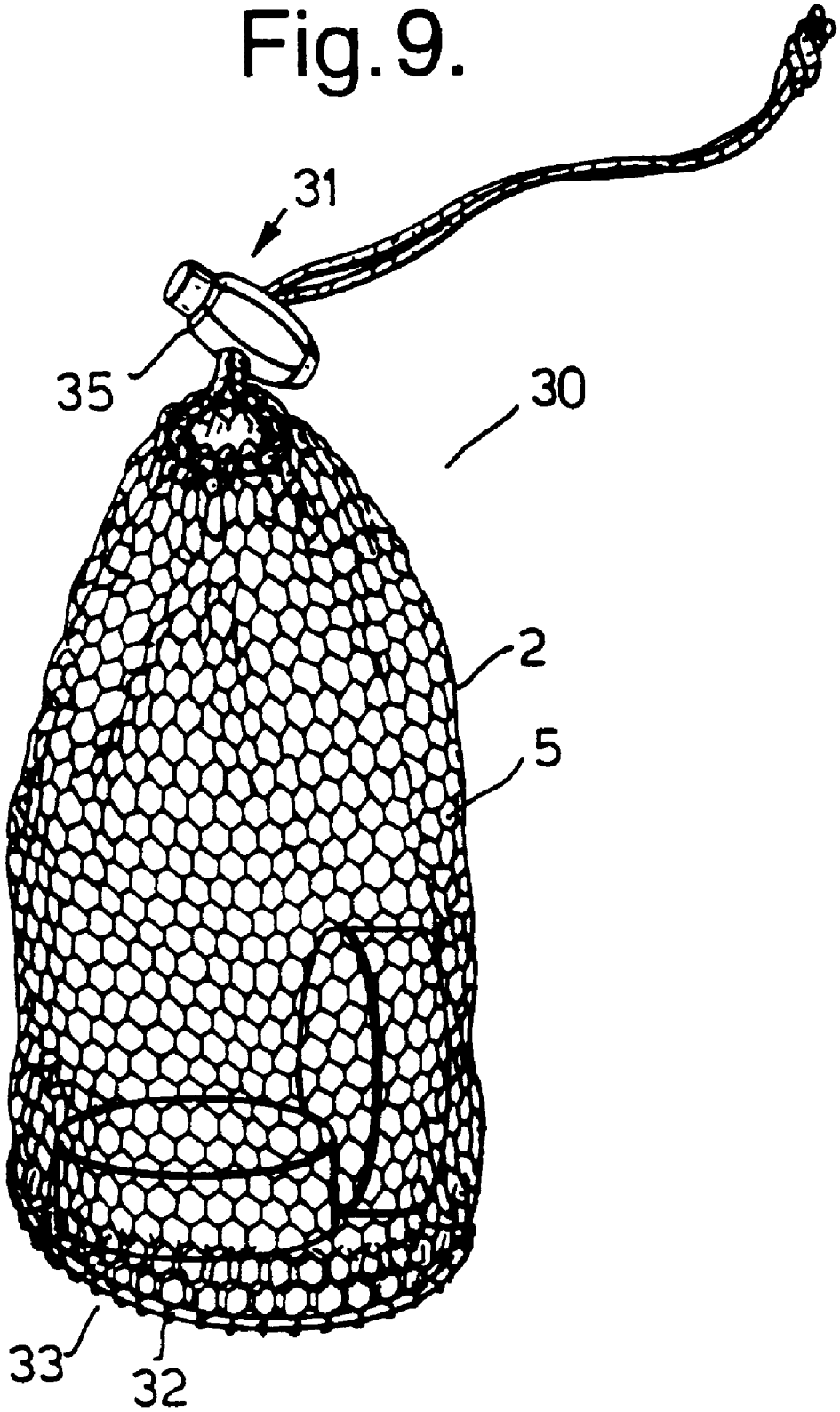
FIG. 9 is a perspective view of a device of FIG. 7 with a pair of tablets inserted therein.

FIG. 9 illustrates the device of FIG. 7 having a pair of detergent tablets inserted therein.

some lodging: ie. tablets dosed in just a small net show some incidence of lodging, although the problem is reduced to a great extent. To circumvent the low risk of lodging, but also the make to make it more easier to find the dosing device after the wash and to favour the water flow through the net, present invention proposes a loosely fitting net bag, which optimally includes some plastic part giving it some volume. This plastic part can be part of the opening system (e.g. a purse type opening with a click mechanism or a plastic system with a tablet push through mechanism) or is part of the net (e.g. a plastic ring attached to the bottom of the net). In the latter example the opening is reclosable by a rope or zipped mechanism.

When dosing tablets in nets it is unexpectedly observed (see Table 1) that there is a clear effect of mesh size of net on level of residue as found after the main wash. Apparently nets with less than 1 mm mesh size retard the tablet dissolution significantly which result in residues in the net. This is judged to be unacceptable. Therefore mesh size of nets should be at least larger than 1 mm. There is an optimal mesh size range; nets with too small a mesh size retard dissolution to an unacceptable level, whereas nets with too large mesh size allow pieces of tablet to "escape" which will increase incidence of lodging and also cause dye damage as direct contact between tablet and load is more pronounced see (See Table 2).

Results also indicate that devices with some volume (for example a plastic ring) give less residue.

TABLE 1

30° C. washes in four machines. Two tablets dosed in net. Program stopped after main wash and level of residues is scored by weight

| | net (zipped) 5 mm mesh size | net zipped 1 mm mesh size | net rope + plastic ring 5 mm mesh size | net rope plastic ring 1 mm mesh size |
|---|---|---|---|---|
| Miele W918 | – | . . . | + | . . . |
| Zanussi Jet | – | . . . | + | . . . |
| Whirlpool | + | . . . | + | . . . |
| Siemens | – | . . . | + | . . . |

+ Totally dissolved after end of main wash
– Some small residues after end of main wash
. . . Between 2.5 and 9 gram after end of main wash When tablets are dosed in a washing machine and especially front loading machines without the use of a dosing device there is a substantial risk of lodging; ie tablets end up in porthole, primarily at the start of the wash. This happens in particular in machines where the space between the door and the drum is such that it can accommodate a tablet or pieces of tablets. The residence time of tablets in a porthole depends on water intake level. As the trend in new machines is to reduce levels of water, even to the extent that the level of water is below the porthole, it is understandable that in such machines tablets do not completely dissolve in the main wash. This will have an effect on performance and level of residues. As an example the Miele W 918™, AEG lavamat™, Hotpoint™, Zanussi Jet™ and Bauknecht Allure™ show severe lodging in 50 to 75% of the washes.

When tablets are dosed via a device, developed such that there is a barrier which prevents that tablets falling out of the device, the problem of lodging is partially solved. The prerequisite for such a device is that it should have some volume otherwise tablets together with device experience From the table below it is clear that concentrated powders (as are on the market) gives more dye fading than free tablets (See Table 2), despite levels of bleach being the same; this is surprising but it can be interpreted by assuming that powders when trapped will have a closer contact with load than tablets. Of course this mimics an extreme situation which is more realistic for a tablet than for a powder, i.e. inherently tablets will dissolve slower than powders.

Surprisingly there is decreasing dye damage upon increasing the mesh size. It was expected that the opposite would occur as one can expect that the larger the mesh size the closer the contact will be between the tablet and the load (see e.g. tablet without net, ie. infinite mesh size, having the most dye fading). Again it seems that there is an optimum in mesh size giving the lowest fading, however it is clear that as the mesh size of the net increases above 1 mm, that dye fading decreases significantly.

As a side effect it was observed that tablets in a net give less residue on the black sachet cloth than when no net was used.

TABLE 2

Combined 40° C. and 60° C. results. Concentrated powder or tablet (with or without net) placed in a small black sachet and a normal wash is conducted in Zanussi Jet ™ machine. After a program, dye fading of the black sachet was measured:

| | Delta E (dye fading) |
|---|---|
| Concentrated Powder | 10.1 |
| Tablet (no net) | 6.0 |
| Tablet (net, zipped) 1 mm mesh size soft quality | 3.9 |
| Tablet (net, zipped) 3 mm mesh size hard quality | 2.5 |
| Tablet (net zipped) 5 mm mesh size hard quality | 2.0 |

To investigate the effect of using dosing devices on residues and dye damage on real load and complete wash cycles and to confirm the above findings the following exercise has been carried out:

A low agitation, low temperature program in a Miele™ washing machine with a load primarily of dark coloured fabrics is repeated a number of times. Products are dosed in the usual way; i.e. powder in scuttle on top of load and tablets on bottom of drum. After a number of washes incidences of residue and dye damage on the load are visually scored (Table 3). N.B. note that with free tablet lodging was observed but tablets were returned to the load.

1 mm mesh size net gives more residue than free tablet in line with above. Apparently tablet dissolution is retarded such that in the latter part of the wash, parts of tablet are still present giving a rise in incidences of residues and dye damage.

Nets with larger mesh sizes (3 mm and 5 mm) reduces the risk of residues and dye damage. It is particularly unexpected, but in line with above results, that the risk of dye damage is reduced.

Also unexpected is the clear better score on dye damage for the tablet in the 5 mm sachet compared to NG Persil Powder (same bleach level).

TABLE 3

Total incidences of residue and dye damage.

| | Residue[1] | Dye Damage |
|---|---|---|
| Free Tablet[2] | 20 | 3 |
| 1 mm net[3] | 31 | 3 |
| 3 mm net | 19 | 2 |
| 5 mm net | 15 | 1 |
| NG Persil Powder | 22 | 4 |

[1]Total residue incidences including patches, particles and filming
[2]Lodging was observed (tablets were returned to the load)
[3]The 1 mm net retained product

DETERGENT TABLET COMPOSITIONS

EXAMPLE 1

Tablets for use in fabric washing were made, starting with a spray-dried base powder of the following composition:

| | |
|---|---|
| Sodium linear alkylbenzene sulphonate | 11.83% |
| Sodium tripolyphosphate, type 1A[1] | 44.83% |
| Nonionic detergent[2] | 7.88% |
| Sodium silicate | 11.83% |
| Soap | 1.13% |
| Sodium carboxymethyl cellulose | 0.9% |
| Acrylate/maleate copolymer | 3. |
| Sodium sulphate and minor ingredients | 3.0% |
| Water | balance to 100% |

[1]This contained less than 30% of the phase I form of anhydrous sodium tripolyphoshate.
[2]$C_{13-15}$ fatty alcohol 7EO.

This powder was mixed with particles of sodium tripolyphosphate specified to contain 70% phase I form and contain 3.5% water of hydration (Rhodia-Phos HPA 3.5 available from Rhone-Poulenc) and other detergent ingredients as tabulated below. As a comparative composition the base powder was mixed with urea and other detergent ingredients.

Two compositions thus contained the following percentages by weight.

| | Example 1 | Comparative A |
|---|---|---|
| Base Powder | 63.25 | 63.25 |
| Sodium perborate tetrahydrate | 10.4 | 10.4 |
| TAED granules | 4.0 | 4.0 |
| Anti-foam granule | 2.0 | 2.0 |
| Enzymes | 0.85 | 0.85 |
| Phosphonate | 0.5 | 0.5 |
| Sodium carbonate | 3.6 | 3.6 |
| HPA Sodium tripolyphosphate | 15.0 | — |
| Urea | — | 15.0 |

35 g portions of each composition were made into cylindrical tablets of 44 mm diameter, using a Carver hand press.

The strength of these tablets was measured using an Instron universal testing machine to compress a tablet until fracture. The value of diametral fracture stress (DFS) was then calculated using the equation.

$$\sigma = \frac{2P}{\pi D t}$$

where σ is the diametral fracture stress in Pascals, P is the applied load in Newtons to cause fracture, D is the tablet diameter in meters and t is the tablet thickness in meters.

The break-up, dispersion and dissolution of tablets was measured by a test procedure in which a tablet is placed on a plastic sieve with 2 mm mesh size which was immersed in 9 liters of demineralised water at ambient temperature of 22° C. and rotated at 200 rpm. The water conductivity was monitored until it reached a constant value.

The time for break up and dispersion of the tables was taken as the time ($T_{90}$) for change in the water conductivity to reach 90% of its final magnitude. This was also confirmed by visual observation of the material remaining on the rotating sieve.

The results were:

| | Example 1 | Comparative A |
|---|---|---|
| Tablet strength (kPa) | 19.5 | 21.9 |
| Tablet dissolution $T_{90}$ (min) | 3.35 | 13.4 |

This shows that tablets of this Example dissolved much faster than the comparative tablets of similar strength made with urea.

EXAMPLE 2

Tablets for use in fabric washing were made, starting with a base powder of the following composition:

| | |
|---|---|
| Coconut alkyl sulphate [1] | 2.9% |
| Zeolite A24 [2] | 52.9% |
| Sodium carbonate | 0.7% |
| Nonionic detergent [3] | 25.9% |
| Soap | 5.9% |
| Sodium carboxymethyl cellulose | 1.4% |
| Fluorescer | 0.4% |
| Acrylate/maleate copolymer | 0.7% |

[1]. The coconut alkyl sulphate was incorporated as preformed granules containing 45% coconut alkyl sulphate, 35% zeolite, 11% sodium carbonate, balance water and other salts.
[2]. Maximum aluminium zeolite P from Crosfields.
[3]. $C_{13-15}$ fatty alcohol 7E0.

This powder was mixed with sodium acetate trihydrate (from Merck as used in Example 1) and other detergent ingredients as tabulated below. As a comparative composition the base powder was mixed with sodium citrate dihydrate and other detergent ingredients and then sprayed with polyethylene glycol (Molecular Weight 1500) at 80° C.

The two compositions thus contained:

| | A (with Na-acetate 3aq). parts by weight | B (comparative) parts by weight |
|---|---|---|
| Base powder | 53.02 | 53.02 |
| Na-perborate 4aq. | 19.99 | 19.99 |
| TAED granules | 4.49 | 4.49 |
| Anti-foam granule | 3.42 | 3.42 |
| Enzymes | 1.5 | 1.5 |
| Phosphonate | 1.0 | 1.0 |
| Perfume | 0.43 | 0.43 |
| Na-acetate 3aq. | 16.13 | |
| Silicate-carbonate co-granule | | 5.5 |
| Na-citrate 2aq. | | 8.03 |
| PEG 1500 | | 2.5 |

35 g portions of each composition were made into cylindrical tablets of 44 mm diameter, using a Carver hand press with various levels of compaction force.

The strength of these tablets was measured using an Instron universal testing machine to compress a tablet until fracture. The value of diametral fracture stress (DFS) was then calculated using the equation $$✦ = \frac{2P}{✣ Dt}$$

where ✦ is the diametral fracture stress in Pascals, P is the applied load in Newtons to cause fracture, D is the tablet diameter in meters and t is the tablet thickness in meters.

The break-up, and dispersion of tablets was measured by the procedure of Example 1, using one tablet on the rotating sieve.

The results are set out in the following table:

| Compaction | A Tablets with Acetate.3H₂O | | B Comparative tablets with citrate and PEG | |
|---|---|---|---|---|
| Force (kN) | Strength (DFS in kPa) | $T_{90}$ (minutes) | Strength (DFS in kPa) | $T_{90}$ (minutes) |
| 1 | 5.1 | 4.0 | — | — |
| 2 | 7.2 | 3.8 | 19.3 | 11.1 |
| 4 | 13.7 | 3.9 | 31 | 25 |
| 5 | 20.8 | 7.5 | 43 | 30 |

It can be seen that the tablets containing acetate trihydrate, made with 5 kN compaction force were almost equal in strength to the comparative tablets made at 2 kN force, but dispersed faster and did not require a process step of spraying polymer onto the powder.

In this specification the term "mesh size" is understood that size of hole which would allow particles of equivalent size or diameter to pass through. Thus a net having a mesh size of 1 mm will allow all particles of average diameter of 1 mm or less to pass through.

Generally the net bag of the invention will be flexible, however, more rigid or resiliently deformable materials may be used within the scope of the invention.

The process and device of the invention may be varied in many ways without departing from the spirit of the invention.

What is claimed is:

1. A dispensing device for a laundry washing machine comprising a net bag for housing one or more detergent tablets, the net bag having a plurality of apertures for permitting the passage of an aqueous solution there through, the device being characterised in that the net bag is a loosely fitting structure, wherein the apertures in the net have an average dimension equivalent to a mesh size of larger than 1 mm and less than 10 mm.

2. A device as claimed in claim 1 in which the apertures have an average mesh size of at least 3 mm.

3. A device as claimed in claim 1 wherein the apertures have an average mesh size of approximately 5 mm.

4. A device as claimed in claim 1 in which the detergent tablet comprises a tripolyphosphate composition.

5. A device as claimed in claim 4 wherein the detergent tablet comprises a compacted particulate detergent composition containing one or more detergent-active compounds together with sodium tripolyphosphate and other ingredients, and in which the tablet or a region thereof comprises particles which contain sodium tripolyphosphate with a content of the phase 1 form which is more than 40% by weight of the sodium tripolyphosphate in said particles, wherein the sodium tripolyphosphate in said particles contains water of hydration distributed throughout the tripolyphosphate in an amount between 1% and 5% by weight of the sodium tripolyphosphate in the particles.

6. A device as claimed in claim 1 in which the detergent tablet comprises sodium acetate trihydrate, optionally together with sodium citrate dihydrate.

7. A device as claimed in claim 6 wherein the detergent tablet comprises a compacted particulate composition in which the tablet or a region thereof comprises 2% to 35% by weight of a salt which is selected from the group consisting of sodium acetate trihydrate, potassium acetate and mixtures thereof, such that the total quantity of the salt is from 7% to 50% by weight of the tablet or a region thereof.

8. A device as claimed in claim 7, wherein the salt in the detergent tablet further comprises sodium citrate dihydrate.

9. A device as claimed in claim 1 wherein the net bag is reusable and comprises an opening for reception of the or each detergent tablet and closure means for closing the opening to prevent the passage of the or each tablet out of the receptacle through the opening.

10. A device as claimed in claim 9 in which the opening is defined by a annular support and in which the closure means comprises a plurality of resiliently flexible members such as fingers mounted on the annular support, which members project radially at least partially across the opening.

11. A device as claimed in claim 9 in which the opening is defined by an annular support, the closure means comprising a diaphragm mounted across the support, which diaphragm includes an aperture for insertion of a tablet.

12. A device as claimed in claim 11 in which the diaphragm comprises a resiliently deformable material.

13. A device as claimed in claim 9 in which the closure means comprises zip means.

14. A device as claimed in claim 9 in which the opening is defined by a pair of lips, which lips are movable together and apart in a purse like manner to open and close the opening.

15. A device as claimed in claim 9 in which the closure means comprises a drawstring arrangement.

16. A device as claimed in claim 15 in which the drawstring arrangement includes clamp means to lock the bag in an open or closed orientation.

17. A device as claimed in claim 1 wherein the net bag further includes a volume adding member.

18. A device as claimed in claim 17 in which the volume adding member comprises an annular ring, which is optionally fixed to base of the bag.

19. A device as claimed in claim 1 in which the net bag is produced from a material capable of withstanding temperatures for the machine washing or drying of laundry, especially up to 150° C.

20. A dispensing device as claimed in claim 1 in combination with a detergent in a solid, non powder form.

21. A dispensing device as claimed in claim 1 in combination with a detergent tablet.

* * * * *